US009382653B2

(12) United States Patent
Kim

(10) Patent No.: US 9,382,653 B2
(45) **Date of Patent: *Jul. 5, 2016**

(54) WASHING MACHINE

(71) Applicant: Dongbu Daewoo Electronics Corporation, Seoul (KR)

(72) Inventor: In Dong Kim, Yongin-si (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 31 days.

This patent is subject to a terminal disclaimer.

(21) Appl. No.: 14/188,058

(22) Filed: Feb. 24, 2014

(65) Prior Publication Data

US 2015/0176175 A1 Jun. 25, 2015

(30) Foreign Application Priority Data

Dec. 24, 2013 (KR) ..... 10-2013-0162799

(51) Int. Cl.

| | |
|---|---|
| ***D06F 37/04*** | (2006.01) |
| ***D06F 37/28*** | (2006.01) |
| *D06F 37/10* | (2006.01) |
| *D06F 23/02* | (2006.01) |
| *D06F 39/08* | (2006.01) |

(52) U.S. Cl.

CPC ..... *D06F 37/28* (2013.01); *D06F 23/025* (2013.01); *D06F 37/10* (2013.01); *D06F 39/08* (2013.01)

(58) Field of Classification Search

CPC ..... D06F 37/04

See application file for complete search history.

(56) References Cited

U.S. PATENT DOCUMENTS

| | | | | |
|---|---|---|---|---|
| 2,586,794 A | | 2/1952 | Douglas | |
| 2,637,186 A | | 5/1953 | Douglas | |
| 3,280,603 A | * | 10/1966 | Schwamm | D06F 37/10 68/139 |
| 4,941,333 A | * | 7/1990 | Blessing | D06F 23/025 68/142 |
| 2009/0000340 A1 | * | 1/2009 | Lim | D06F 37/22 68/140 |

FOREIGN PATENT DOCUMENTS

| | | | |
|---|---|---|---|
| DE | 2301341 | A | 7/1973 |
| DE | 19828870 | A1 | 12/1999 |
| EP | 0381423 | A1 | 8/1990 |
| FR | 1193840 | A | 11/1959 |
| JP | 2002529172 | A | 9/2002 |
| KR | 1020030040116 | | 5/2003 |
| KR | 1020060042684 | | 5/2006 |

* cited by examiner

*Primary Examiner* — Jason Ko

(57) ABSTRACT

The present disclosure relates to a washing machine that may include an integrated tub/drum that has a cylindrical shape or a truncated conical shape, stores water, holds or accommodates laundry together with the water, rotates, and has an opening in one region of the integrated tub/drum; a drum cover that separably or removably covers the opening of the integrated tub/drum and is separable or removable from the opening; and a cover hinge that is at one side and/or edge of the opening of the integrated tub/drum, and rotatably supports one side of the drum cover.

9 Claims, 10 Drawing Sheets

WASHING MACHINE

CROSS-REFERENCE TO RELATED APPLICATIONS

This application is based on and claims priority from Korean Patent Application No. 10-2013-0162799, filed on Dec. 24, 2013, with the Korean Intellectual Property Office, the disclosure of which is incorporated herein in its entirety by reference.

TECHNICAL FIELD

The present disclosure relates to a washing machine, and more particularly, to a washing machine having an integral tub and drum configured to store water, hold or accommodate laundry, and rotate (e.g., an integrated tub/drum).

BACKGROUND

A washing machine is an apparatus that eliminates foreign substances in and/or attached to laundry by agitating and rotating water, detergent, and the laundry. Washing machines may be classified into a pulsator type washing machine that washes the laundry using a water flow generated by a pulsator in the washing tub, and a drum type washing machine that washes laundry by dropping the laundry vertically as a result of rotation of the drum.

The drum type washing machine has a door that is at the front of the washing machine. The user puts the laundry in the washing machine through the door, and the drum type washing machine lifts and drops the laundry to wash the laundry, using relatively small amounts of water and detergent. Specifically, a drum type washing machine in the related art includes a cabinet that forms an external appearance and/or structure of the washing machine, a tub that is in the cabinet and stores water, a rotatable drum that is in the tub and holds or accommodates laundry, a drive motor that is behind and/or below the tub and provides power to the drum, a water supply device (e.g., a pump and/or valve) that supplies water to the tub, and a drain that discharges water in the tub to the outside of the cabinet after a washing operation ends.

Accordingly, when the laundry is washed using the drum type washing machine in the related art, the laundry is put into the tub laterally by opening the door at the front of the washing machine, water is supplied to the tub, and then the laundry is washed while a lifter in the drum lifts up and drops the laundry by rotating the drum using power from the drive motor.

As such, the drum type washing machine in the related art includes a separate tub in addition to the drum. That is, the drum type washing machine in the related art has a structure that includes the tub to store water and the drum in the tub to wash the laundry.

However, because the tub is typically made of a plastic material, the tub may be easily contaminated by mold, mildew, water scale or other foreign substances entering or generated in the tub when the tub is used over a long period of time. There is a problem in that it is difficult to clean the tub when the tub is contaminated because the drum must be removed first. When the tub is contaminated, the tub may become corroded or contaminated, and then the laundry may become contaminated, which may cause a user to incur skin irritation or a skin disease.

This problem also exists in the pulsator type washing machine as well as the drum type washing machine. The reason is that the pulsator type washing machine also includes a reservoir (tub) in a main body thereof.

According to the drum type washing machine in the related art, the drum rotates by supporting one side of the drum using a single shaft, and thus, there is also a problem in that vibration(s) and noise may occur due to deflection(s) of the shaft.

SUMMARY

The present disclosure has been made in an effort to provide a washing machine that uses an integrated tub/drum, thereby suppressing the generation of contaminants and allowing the integrated tub/drum to be easily cleaned.

The present disclosure has been made in an effort to provide a washing machine that may effectively put laundry into an integrated tub/drum or take the laundry out of the integrated tub/drum.

One or more exemplary embodiments of the present disclosure provide a washing machine including an integrated tub/drum that has a cylindrical shape or a truncated conical shape, stores water, holds or accommodates laundry with the water, rotates, and has an opening in one region of the integrated tub/drum; a drum cover that separably or removably covers the opening of the integrated tub/drum; and a cover hinge that is at one side and/or edge of the opening of the integrated tub/drum, and supports one side of the drum cover so that the drum cover can rotate.

The drum cover may further include a lock that restricts motion of the drum cover when the opening of the integrated tub/drum is closed.

The washing machine may further include a hollow rotary shaft that is coupled to and/or that penetrates one end or surface of the integrated tub/drum; and one or more water pipes that are in the integrated tub/drum through the hollow rotary shaft.

The one or more water pipes may include a water supply pipe and a water drain pipe, and the water drain pipe may be in the integrated tub/drum and through the hollow rotary shaft, and bend downward in the integrated tub/drum.

The water supply pipe may be in the integrated tub/drum through the hollow rotary shaft, and bend upward and/or leftward or rightward.

The washing machine may further include a drive shaft that is coupled to another end surface of the integrated tub/drum (e.g., opposite to the end or surface coupled to and/or penetrated by the hollow rotary shaft); and a drive motor that rotates the drive shaft.

Another exemplary embodiment of the present disclosure provides a washing machine including an integrated tub/drum that has a cylindrical shape or a truncated conical shape, stores water, holds or accommodates laundry with the water, rotates, and has an opening in one region of the integrated tub/drum; and a slidable drum cover that is coupled to the integrated tub/drum and configured to open and close the opening.

The drum cover may include a lock that restricts motion of the drum cover when the opening of the integrated tub/drum is closed.

The washing machine may further include a guide rail that is at an edge of the opening of the integrated tub/drum; and a sliding hinge module that is coupled to the guide rail, and supports the drum cover. In one or more such embodiments, the drum cover can rotate.

The sliding hinge module may move the drum cover from the opening of the integrated tub/drum away from a center of the integrated tub/drum, and thereafter may be movable along the guide rail.

The integrated tub/drum may further include a cover accommodating fixture that may be at one side and/or opposite to the opening, configured to hold or accommodate the drum cover (e.g., so that the drum cover is slidable), and one side of the drum cover may reciprocate in the cover accommodating fixture of the integrated tub/drum such that another side of the drum cover opens and closes the opening of the integrated tub/drum.

In the washing machine, the integrated tub/drum may further include a groove or slot (e.g., that may be at or in another side, such as one side of the opening, opposite to the cover accommodating fixture, and the opening may be therebetween), and the other side of the drum cover (e.g., the side that opens and closes the opening, or an edge thereof) may be in the groove or slot when the drum cover closes the opening.

The washing machine may further include a hollow rotary shaft that is coupled to and/or that penetrates one end or surface of the integrated tub/drum; and one or more water pipes that are in the integrated tub/drum and through the hollow rotary shaft.

The one or more water pipes may include a water supply pipe and a drain pipe, and the drain pipe may bend downward in the integrated tub/drum.

The water supply pipe may be in the integrated tub/drum and through the hollow rotary shaft, and bend upward and/or leftward or rightward in the integrated tub/drum.

The washing machine may further include a drive shaft that is coupled to another end or surface of the integrated tub/drum; and a drive motor that rotates the drive shaft.

According to exemplary embodiments of the present disclosure, the washing machine uses an integrated tub/drum, thereby suppressing formation of contaminants and allowing the integrated tub/drum to be easily cleaned.

Exemplary embodiments of the present disclosure provide a washing machine that may effectively enable facile placement of the laundry into the integrated tub/drum or removal of the laundry from the integrated tub/drum.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
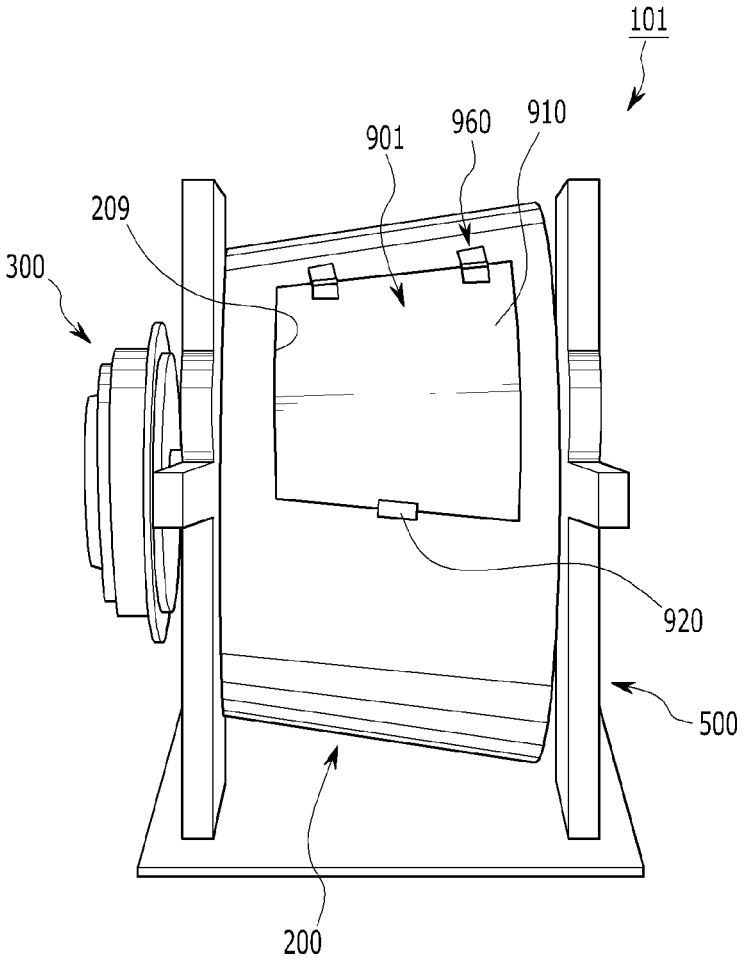
FIG. 1 is a perspective view of a washing machine according to one or more exemplary embodiments of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Hereinafter, exemplary embodiments of the present disclosure will be described in detail with reference to the accompanying drawings so that those skilled in the technical field to which the present disclosure pertains may easily carry out the exemplary embodiments. The present disclosure may be implemented in various different forms, and is not limited to the exemplary embodiments described herein.

In several exemplary embodiments, constituent elements having the same structure or configuration will be representatively described using the same reference numerals in one exemplary embodiment, and in other exemplary embodiments, only constituent elements that are different from the constituent elements described in the one exemplary embodiment will be described.

The drawings are schematically illustrated, and the scales of the drawings are not necessarily identical to each other. Relative dimensions and ratios of the parts illustrated in the drawings may be exaggerated or reduced in terms of sizes thereof for clarification of the drawings and convenience, and any particular dimension is only illustrative, and is not limited thereto. The same structures, elements or components illustrated in two or more drawings may be designated by the same reference numerals so as to illustrate the same or similar features.

Disclosed embodiments of the present disclosure are specifically presented as ideal exemplary embodiments of the present disclosure. As a result, various modifications of the drawings are expected. Therefore, the exemplary embodiments are not limited to specific forms or regions illustrated in the drawings, and for example, include modifications of form by manufacturing.

Hereinafter, a washing machine 101 according to one or more exemplary embodiments of the present disclosure will be described with reference to FIGS. 1 to 5.

Figure 4:
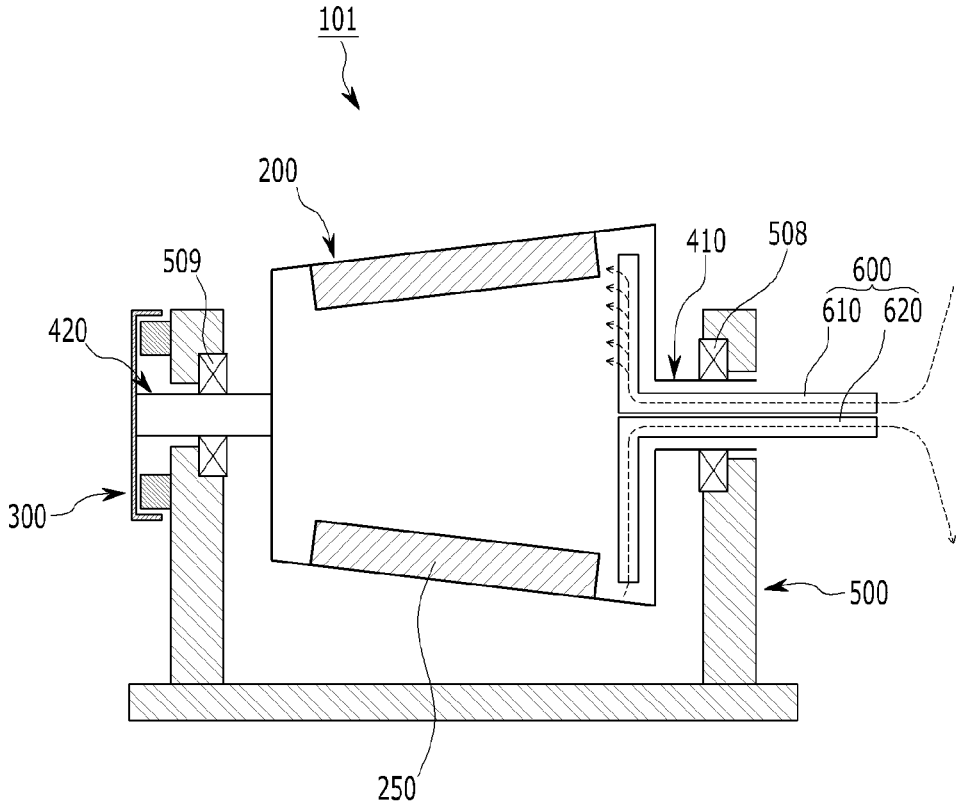
FIG. 4 is a cross-sectional view of the exemplary washing machine of FIG. 1.

As illustrated in FIGS. 1 and 4, the washing machine 101 according to one or more exemplary embodiments of the present disclosure includes an integrated tub/drum 200, a drum cover 901, and a cover hinge 960.

The washing machine 101 according to one or more exemplary embodiments of the present disclosure may further include a hollow rotary shaft 410, a water pipe 600 that includes a water supply pipe 610 and a drain pipe 620, one or more lifters 250, a supporting frame 500, a supporting bearing 508, a drive bearing 509, a drive shaft 420, and a drive motor 300.

Figure 5:
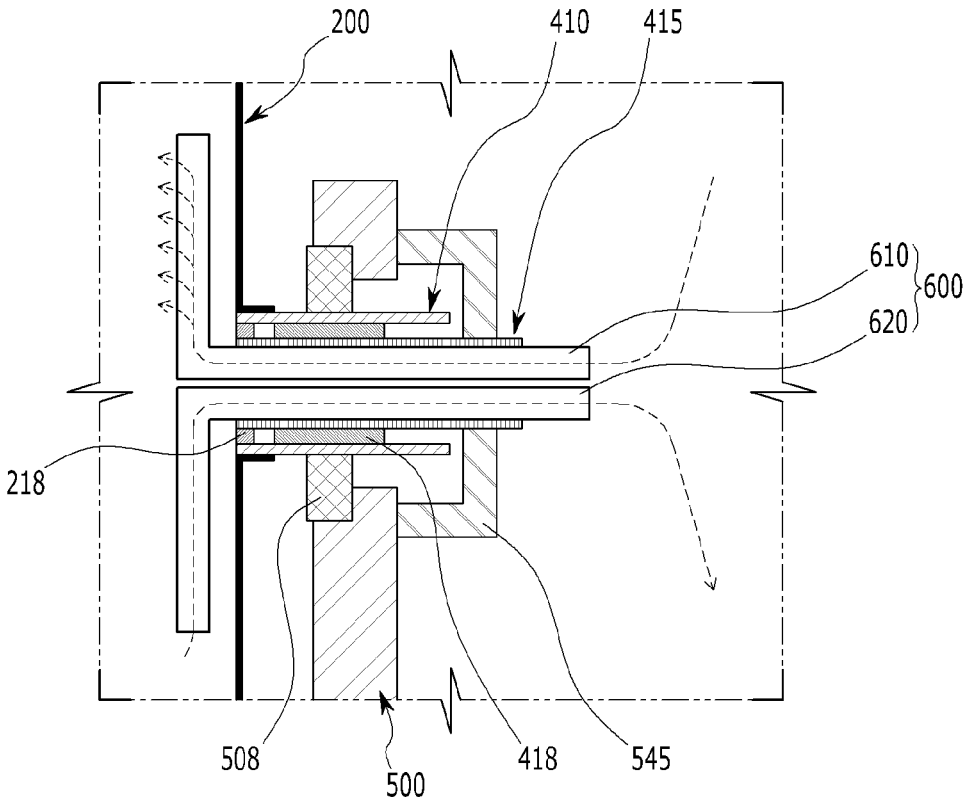
FIG. 5 is a detailed cross-sectional view of the exemplary hollow rotary shaft of FIG. 4.

As illustrated in FIG. 5, the washing machine 101 according to one or more exemplary embodiments of the present disclosure may further include a fixed shaft 415, a rotary bearing 418, a water seal 218, and a shaft fixture 545.

Although not illustrated, the washing machine 101 according to one or more exemplary embodiments of the present disclosure may further include a cabinet, and a water supply valve and/or pump, and a drain pump.

The cabinet forms an external shape, appearance and/or structure of the washing machine 101, and a control panel for controlling the washing machine 101 may be installed on and/or in the cabinet. Because the cabinet may have one of various shapes that are known to those skilled in the art, a detailed description thereof will be omitted.

The water supply valve and/or pump supplies water through the water supply pipe 610, and the drain pump drains water through the drain pipe 620. Because the water supply valve and/or pump and the drain pump used in the washing machine 101 are also known to those skilled in the art, a detailed description thereof will be omitted.

The integrated tub/drum 200 stores water, holds or accommodates laundry together with the water and detergent, and rotates. The integrated tub/drum 200 may comprise or be made of stainless steel. Alternatively, the integrated tub/drum 201 may comprise or be made of another metal and/or plastic, and have a ceramic and/or stain-resistant coating on the inner surface thereof. Thus, according to one or more exemplary embodiments of the present disclosure, the integrated tub/drum 200, which holds water, is not easily contaminated by mold, mildew, water scale or other foreign substances, and may be easily cleaned when the integrated tub/drum 200 is contaminated. In the case of a washing machine in which a tub and a drum are separate, there is a problem in that the drum needs to be separated or removed from the tub in order to clean the tub, but embodiments of the present disclosure include the integrated tub/drum 200, which may be easily cleaned.

The integrated tub/drum 200 has a truncated conical shape having vertical ends and/or side surfaces that intersect a rotation center axis of the integrated tub/drum 200 and that have different areas. However, embodiments of the present disclosure are not particularly limited thereto, and the integrated tub/drum 200 may also have a cylindrical shape.

In one or more exemplary embodiments of the present disclosure, the integrated tub/drum 200 may include an opening 209 that is in one region of a circumferential surface of the integrated tub/drum 200. The laundry may be put into the integrated tub/drum 200, or the laundry in the integrated tub/drum 200 may be taken out of the integrated tub/drum 200, through the opening 209.

The drum cover 901 separably or removably covers the opening 209 of the integrated tub/drum 200. That is, the drum cover 901 opens and closes the opening 209 of the integrated tub/drum 200. The drum cover 290 is separated from the integrated tub/drum 200 when the laundry is put into or taken out of the integrated tub/drum 200, and coupled to the opening 209 of the integrated tub/drum 200 configured to seal an internal space of the integrated tub/drum 200 when the laundry is washed.

Specifically, the drum cover 901 may include a cover main body 910, and a lock 920. The cover main body 910 opens and closes the opening 209 of the integrated tub/drum 200, and the lock 920 restricts motion of the cover main body 910 when the cover main body 910 closes the opening 209 of the integrated tub/drum 200.

In one or more exemplary embodiments of the present disclosure, the lock 920 may be variously formed depending on the technology that is publicly known to those skilled in the art.

The cover hinge 960 is at one side and/or edge of the opening 209 of the integrated tub/drum 200, and supports one side of the drum cover 901 so that the drum cover 901 is rotatable.

Figure 2:
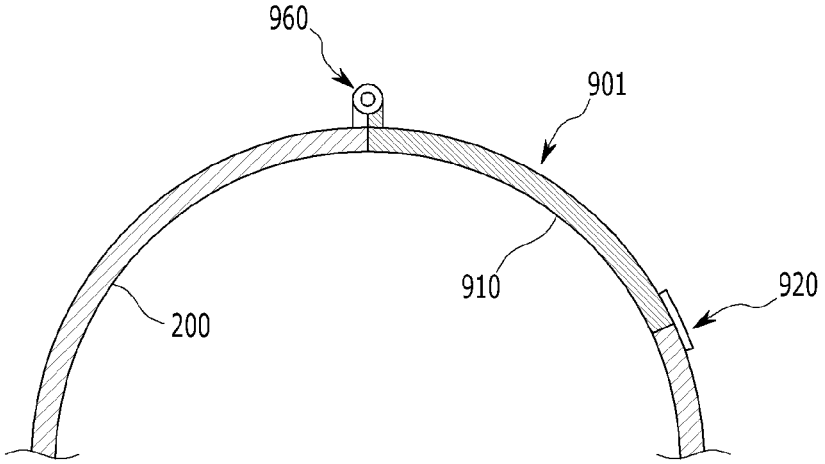
FIGS. 2 and 3 are cross-sectional views illustrating operational states of the exemplary integrated tub/drum and drum cover of FIG. 1.
Figure 3:
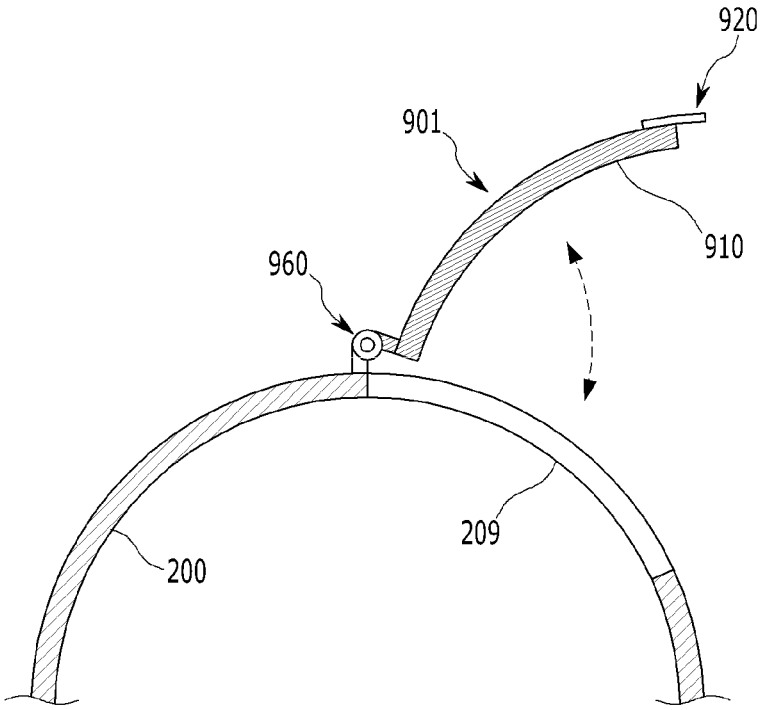

That is, as illustrated in FIGS. 2 and 3, the drum cover 901 may open and close the opening 209 of the integrated tub/drum 200 using the cover hinge 960.

As illustrated in FIG. 4, a plurality of lifters 250 may be inside the integrated tub/drum 200. Each lifter 250 may extend or protrudes from an inner circumferential surface of the integrated tub/drum 200 at or to a predetermined height in a direction toward a center of the integrated tub/drum 200, and have a shape that enables lifting and dropping of the laundry as the integrated tub/drum 200 rotates.

Accordingly, when the integrated tub/drum 200 rotates, the laundry held or accommodated in the integrated tub/drum 200 is washed while being caught and lifted by the lifters 250 due to rotational force of the integrated tub/drum 200, then being dropped back into the water and detergent in the bottom of the integrated tub/drum 200.

The supporting frame 500 supports the hollow rotary shaft 410 so that the hollow rotary shaft 410 can rotate. The supporting frame 500 may be held or accommodated in or coupled to the cabinet (not illustrated). The supporting frame 500 may have one of a variety of shapes that intersect in an 'X' shape, 'V' shape, inverted 'V' shape, etc., and the hollow rotary shaft 410 may be supported at the intersection or vertex thereof.

However, embodiments of the present disclosure are not limited thereto, and the supporting frame 500 may have any of various structures that may be modified and carried out by those skilled in the art based on known technology.

The water supply pipe 610 and the drain pipe 620 are in the integrated tub/drum 200 and through the hollow rotary shaft 410. The water supply pipe 610 supplies water to the interior of the integrated tub/drum 200, and the drain pipe 620 discharges water from the interior of the integrated tub/drum 200.

In one or more exemplary embodiments of the present disclosure, the drain pipe 620 may pass through the hollow rotary shaft 410, and bent downward in the integrated tub/drum 200.

The hollow rotary shaft 410 is coupled to and/or penetrates one vertical end and/or surface of the integrated tub/drum 200 that has a relatively large area, and thus the drain pipe 620, which bends downward, is also adjacent to the one vertical end and/or surface of the integrated tub/drum 200 that has the relatively large area (e.g., in comparison to the other vertical end and/or surface).

Depending on a gradient of the integrated tub/drum 200 having a truncated conical shape, water collects in an area near the one vertical end and/or surface of the integrated tub/drum 200 that has the relatively large area.

Accordingly, the drain pipe 620 may effectively drain the water that collects toward the one vertical end and/or surface of the integrated tub/drum 200 that has the relatively large area.

In one or more exemplary embodiments of the present disclosure, the water supply pipe 610 may pass through the hollow rotary shaft 410, and bend upward, and/or leftward or rightward, in the integrated tub/drum 200. FIG. 2 illustrates a water supply pipe 610 that bends upward, but embodiments of the present disclosure are not limited thereto, and the water supply pipe 610 may bend leftward or rightward, or may not bend at all.

The hollow rotary shaft 410 is coupled to and/or penetrates the one vertical end and/or surface of the integrated tub/drum 200 such that a hollow space of the hollow rotary shaft 410 communicates with the interior of the integrated tub/drum 200. When the integrated tub/drum 200 has a truncated conical shape, the hollow rotary shaft 410 is coupled to and/or penetrates the one vertical end and/or surface of the integrated tub/drum 200 that has a relatively large area.

The fixed shaft 415 is in the hollow space of the hollow rotary shaft 410 and is configured not to rotate. The fixed shaft 415 supports the water supply pipe 610 and the drain pipe 620 therein. When the hollow rotary shaft 410 rotates, the water supply pipe 610 and the drain pipe 620 in the fixed shaft 415 do not rotate.

As illustrated in FIG. 5, one end of the fixed shaft 415 protrudes or extends outside of the hollow rotary shaft 410, and the shaft fixture 545 connects the one end of the fixed shaft 415 to the supporting frame 500. That is, the shaft fixture 545 is coupled to the supporting frame 500 and configured to support the fixed shaft 415 so that the fixed shaft 415 does not rotate in the hollow rotary shaft 410.

The rotary bearing 418 is between the hollow rotary shaft 410 and the fixed shaft 415 so that the hollow rotary shaft 410 and the fixed shaft 415 are rotatable or slidable relative to each other. That is, the rotary bearing 418 enables the hollow rotary shaft 410 to rotate when the fixed shaft 415 is fixed. For example, the rotary bearing 418 may comprise or be a needle roller bearing.

The water seal 218 is between the hollow rotary shaft 410 and the fixed shaft 415, and is configured to block the water in the integrated tub/drum 200 from flowing into the rotary bearing 418 through the hollow space of the hollow rotary shaft 200.

The supporting bearing 508 is between the hollow rotary shaft 410 and the supporting frame 500. The supporting bearing 508 helps the supporting frame 500 to support the hollow rotary shaft 410 so that the hollow rotary shaft 410 can rotate.

As illustrated previously in FIG. 4, the drive shaft 420 is coupled to the other vertical end and/or surface of the integrated tub/drum 200 (that is, the end or surface that is opposite to the one end or surface to which the hollow rotary shaft 410 is coupled). That is, the integrated tub/drum 200 rotates while being supported by the drive shaft 420 and the hollow rotary shaft 410.

Like the hollow rotary shaft 410, the drive shaft 420 is also supported by the supporting frame 500. The drive shaft 420 may also be supported at the intersection or vertex of the supporting frame 500 (e.g., on a side of the integrated tub/drum 200 opposite from the hollow rotary shaft 410).

The drive bearing 509 is between the drive shaft 420 and the supporting frame 500. That is, the drive bearing 509 helps the supporting frame 500 to support the drive shaft 420 and enable the drive shaft 420 to rotate.

The drive motor 300 rotates the drive shaft 420, and provides rotational power to the integrated tub/drum 200.

In one or more exemplary embodiments of the present disclosure, the drive motor 300 may rotate the integrated tub/drum 200 so that the opening 209 of the integrated tub/drum 200 is positioned at a relatively upper location (e.g., the top or near the top of the integrated tub/drum 201; for example, between 10 o'clock and 2 o'clock when viewing the end of the integrated tub/drum 201 as a clock face) when the laundry is put into or taken out of the integrated tub/drum 200. That is, the drive motor 300 may move the opening 209 of the integrated tub/drum 200 to a position where the user can conveniently put the laundry into the integrated tub/drum 200 or take the laundry out of the integrated tub/drum 200.

According to the aforementioned configuration, the washing machine 101 according to one or more exemplary embodiments of the present disclosure uses the integrated tub/drum 200 to suppress the formation and/or generation of contaminants, and allow the integrated tub/drum 200 to be easily cleaned.

According to one or more exemplary embodiments of the present disclosure, the laundry may be easily put into or taken out of the integrated tub/drum 200. The opening 209 of the integrated tub/drum 200 may be effectively sealed when the laundry is washed.

According to one or more exemplary embodiments of the present disclosure, the drive shaft 420 and the hollow rotary shaft 410 rotate while supporting opposed ends and/or surfaces of the integrated tub/drum 200, such that cantilevered beam deflection of the shaft may be reduced or prevented, as compared to the case in which the drum rotates with a single shaft connected to one end or surface of the drum, thereby reducing vibrations and noise.

Hereinafter, a washing machine 102 according to one or more further exemplary embodiments of the present disclosure will be described with reference to FIG. 6.

Figure 6:
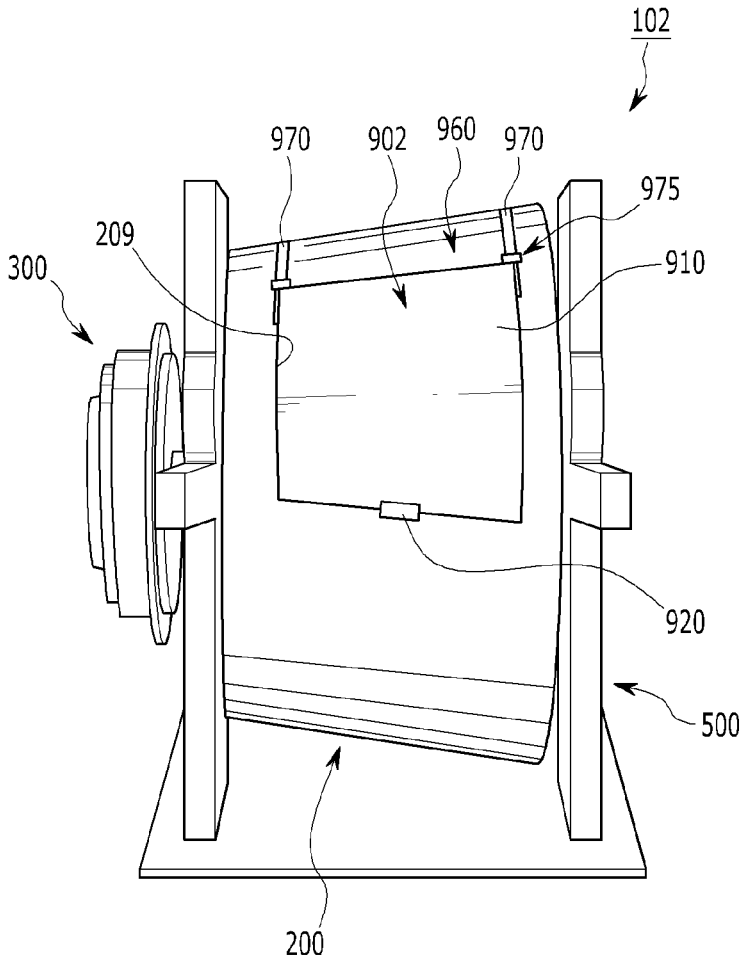
FIG. 6 is a perspective view of an exemplary washing machine according to one or more embodiments of the present disclosure.

As illustrated in FIG. 6, the washing machine 102 according to one or more exemplary embodiments of the present disclosure includes a slidable drum cover 902 coupled to the integrated tub/drum 200, configured to open and close the opening 209.

The washing machine 101 according to one or more further exemplary embodiments of the present disclosure includes a guide rail 970 and a sliding hinge module 975. The cover hinge 960 of other exemplary embodiments is omitted.

The guide rail 970 is at and/or along an edge of the opening 209 of the integrated tub/drum 200. The sliding hinge module 975 is slidably coupled to the guide rail 970, and supports the drum cover 902 and enables the drum cover 902 to rotate.

Figure 7:
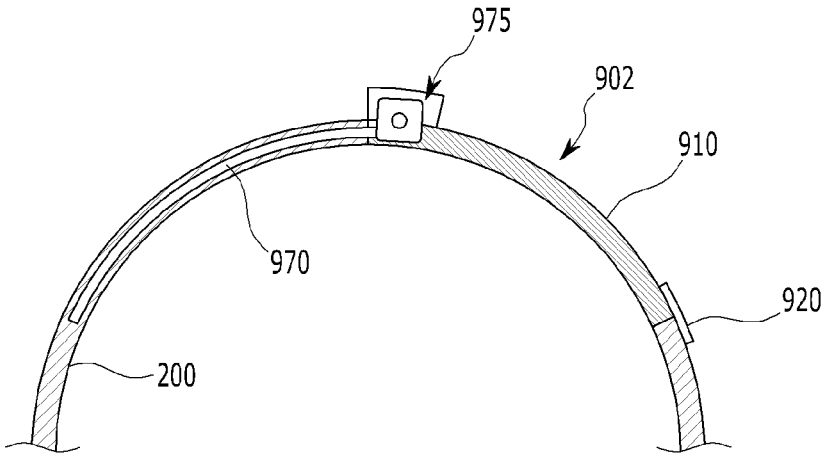
FIGS. 7 and 8 are cross-sectional views illustrating operational states of the exemplary integrated tub/drum and drum cover of FIG. 6.
Figure 8:
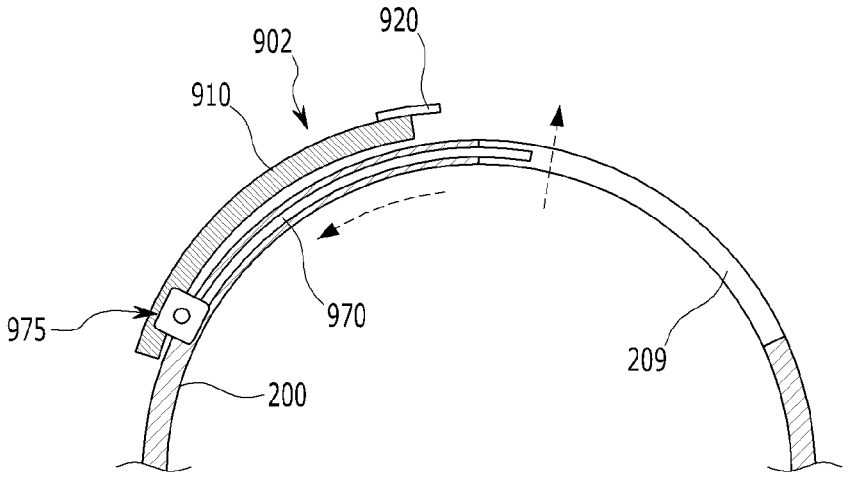

Specifically, as illustrated in FIGS. 7 and 8, the sliding hinge module 975 rotates and is configured to move the drum cover 902 from the opening 209 of the integrated tub/drum 200 in a direction away from the center or interior of the integrated tub/drum 200, and thereafter, the sliding hinge module 975 moves along the guide rail 970 to open the opening 209 of the integrated tub/drum 200.

The sliding hinge module 975 may use a technology that is applied to a slide type mobile phone and/or a sliding door of a van, and the operation principles of sliding covers and/or doors including hinges such as the sliding hinge module 975 are known to those skilled in the art.

Like other exemplary embodiments, when a cover main body 910 of the drum cover 902 seals the opening 209 of the integrated tub/drum 200, the lock 920 restricts motion of the cover main body 910.

According to the aforementioned configuration(s), the washing machine 102 according to one or more further exemplary embodiments of the present disclosure may efficiently open and close the opening 209 of the integrated tub/drum 200 even when the washing machine 102 is in a small or narrow space.

That is, when the drum cover 901 rotates about the cover hinge 960 to open and close the opening 209 of the integrated tub/drum 200 as described in one or more exemplary embodiments of the present disclosure, the drum cover 901 opens in a space above the integrated tub/drum 200 in accordance with a radius of rotation of the drum cover 901.

However, according to one or more further exemplary embodiments, the drum cover 902 slides to open and close the opening 209 of the integrated tub/drum 200, and thus the opening 209 may be effectively opened and closed when the washing machine is in a small, low or a narrow space.

Hereinafter, a washing machine 103 according to one or more still further exemplary embodiments of the present disclosure will be described with reference to FIGS. 9 and 10.

Figure 9:
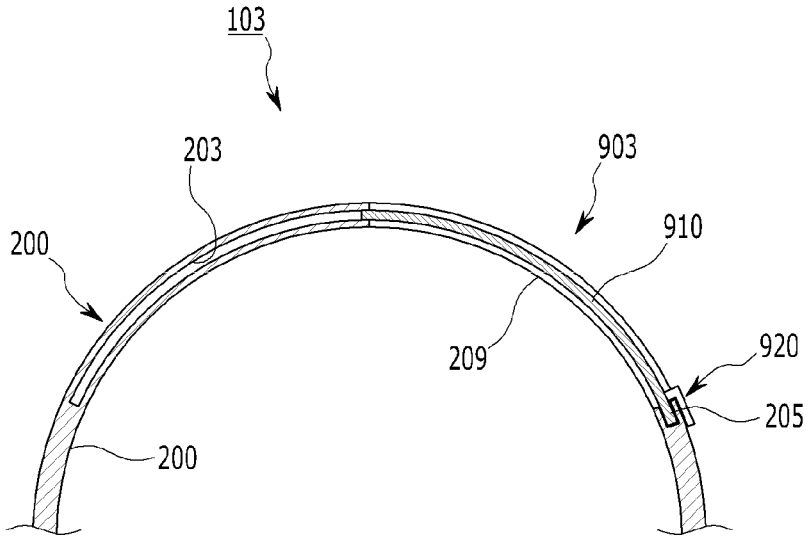
FIGS. 9 and 10 are cross-sectional views illustrating operational states of another exemplary integrated tub/drum and drum cover that may be used in a washing machine according to one or more embodiments of the present disclosure.
Figure 10:
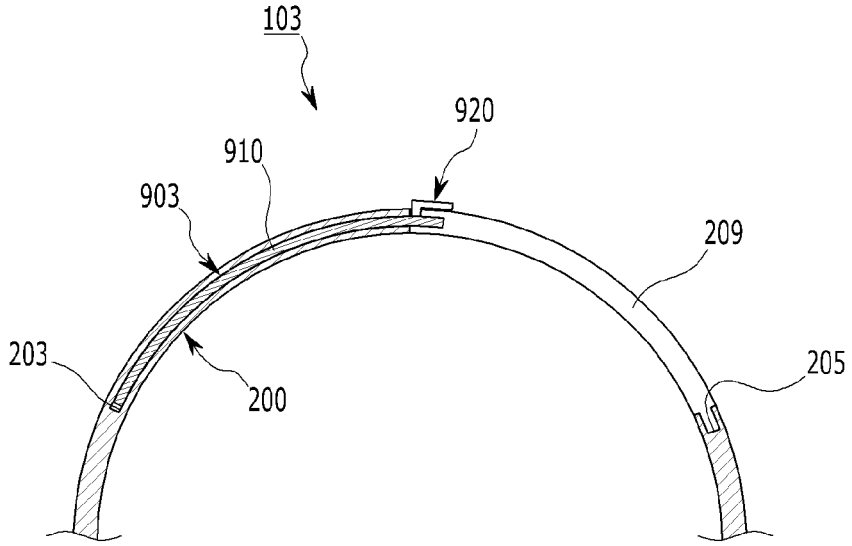

As illustrated in FIGS. 9 and 10, the washing machine 103 according to one or more exemplary embodiments of the present disclosure includes a cover accommodating fixture 203 that is at one side and/or along one edge of the opening 209, that is configured to hold or accommodate a slidable drum cover 903, and a groove or slot 205 is at another side of the opening 209 opposite to the cover accommodating fixture 203, with the opening 209 therebetween.

The drum cover 903 (or a side or portion thereof) reciprocates in (or slides into and out of) the cover accommodating fixture 203 of the integrated tub/drum 200, and the drum cover 903 (or another side thereof) opens and closes the opening 209 of the integrated tub/drum 200 thereby.

When the drum cover 903 closes the opening 209, an edge of the drum cover 903 (e.g., that does not enter the cover accommodating fixture 203) enters the groove or slot 205, thereby sealing the opening 209 of the integrated tub/drum 200. In one example, the drum cover 903 may have a thickness about the same as or slightly greater than that of the groove or slot 205, and at least one of the groove or slot 205 and the cover accommodating fixture 203 may comprise a relatively compressible material. In another case, a packing member or gasket (not illustrated) may be in or at the groove or slot 205, or along the edge of the drum cover 903, thereby more effectively maintaining airtightness when the drum cover 903 is closed.

Like other exemplary embodiments, when a cover main body 910 of the drum cover 903 tightly closes the opening 209 of the integrated tub/drum 200, a lock 920 restricts motion of the cover main body 910.

According to the aforementioned configuration(s), the washing machine 103 according to one or more exemplary embodiments of the present disclosure may efficiently open and close the opening 209 of the integrated tub/drum 200 using a simple structure.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A washing machine comprising:

an integrated tub/drum that has a cylindrical shape or a truncated conical shape and is configured to store water, holds or accommodates laundry together with the water, rotates, and has an opening in one region of the integrated tub/drum;

a slidable drum cover that is coupled to the integrated tub/drum and configured to open and close the opening;

a guide rail at an edge of the opening of the integrated tub/drum; and a sliding hinge module that is slidably coupled to the guide rail, and supports the drum cover, wherein the sliding hinge module moves the drum cover from the opening of the integrated tub/drum in a direction away from a center of the integrated tub/drum, and thereafter is movable along the guide rail.

2. The washing machine of claim 1, wherein the drum cover includes a lock that restricts motion of the drum cover when the opening of the integrated tub/drum is closed.

3. The washing machine of claim 1, wherein the drum cover is rotatable.

4. The washing machine of claim 1, further comprising:

a hollow rotary shaft that is coupled to and/or that penetrates one surface of the integrated tub/drum; and one or more water pipes that are in the integrated tub/drum and through the hollow rotary shaft.

5. The washing machine of claim 4, wherein the one or more water pipes include a water supply pipe and a drain pipe, and the drain pipe is in the integrated tub/drum and through the hollow rotary shaft.

6. The washing machine of claim 5, wherein the drain pipe bends downward.

7. The washing machine of claim 5, wherein the water supply pipe is in the integrated tub/drum and through the hollow rotary shaft.

8. The washing machine of claim 7, wherein the water supply pipe bends upward, and/or leftward or rightward.

9. The washing machine of claim 4, further comprising:

a drive shaft that is coupled to the other surface of the integrated tub/drum; and a drive motor that rotates the drive shaft.

* * * * *